US006123154A

United States Patent [19]

MacDonald, III et al.

[11] Patent Number: 6,123,154

[45] **Date of Patent: *Sep. 26, 2000**

[54] SUPPORT SYSTEM ATTACHMENT MECHANISM FOR FIRE PROTECTION SPRINKLERS

[75] Inventors: Norman J. MacDonald, III, Lunenburg; Peter M. MacDonald, Boxboro; Paul S. F. Silcox, Pembroke, all of Mass.

[73] Assignee: PNM, Inc., Acton, Mass.

[ * ] Notice: This patent is subject to a terminal disclaimer.

[21] Appl. No.: 09/228,082

[22] Filed: Jan. 8, 1999

[51] Int. Cl.[7] ..... A62C 37/08

[52] U.S. Cl. ..... 169/37; 169/16; 169/41; 52/39; 52/506.06; 52/506.07; 239/209; 239/600; 239/588; 248/56; 248/59; 248/75; 248/214; 248/343; 285/31

[58] Field of Search ..... 169/16, 37, 41; 248/57, 59, 56, 70, 75, 214, 342, 343; 52/39, 506.06, 506.07; 239/208, 209, 280.5, 281, 587.1, 588, 600; 285/31

[56] References Cited

U.S. PATENT DOCUMENTS

| | | | |
|---|---|---|---|
| 1,056,759 | 3/1913 | Mallery . | |
| 1,156,885 | 10/1915 | Caine . | |
| 3,597,889 | 8/1971 | Nigro . | |
| 3,797,789 | 3/1974 | Wasson | 248/214 |
| 4,041,657 | 8/1977 | Schuplin . | |
| 4,122,762 | 10/1978 | Williams . | |
| 4,149,693 | 4/1979 | LoNigro . | |
| 4,484,634 | 11/1984 | Swanson et al. | 169/52 |
| 4,717,099 | 1/1988 | Hubbard | 248/57 |
| 4,785,887 | 11/1988 | Miller | 169/37 |
| 4,834,186 | 5/1989 | Ballard | 169/16 |
| 5,018,586 | 5/1991 | Cawley et al. | 169/56 |
| 5,085,393 | 2/1992 | Ryan . | |
| 5,127,479 | 7/1992 | Stehling et al. | 169/65 |
| 5,316,254 | 5/1994 | McCartha . | |
| 5,396,959 | 3/1995 | Macdonald | 169/51 |
| 5,516,068 | 5/1996 | Rice . | |
| 5,564,505 | 10/1996 | Moliere | 169/16 |
| 5,570,745 | 11/1996 | MacDonald, III | 169/16 |
| 5,609,212 | 3/1997 | McHugh | 169/52 |
| 5,619,263 | 4/1997 | Laughlin et al. | 248/343 |
| 5,667,018 | 9/1997 | Hone et al. | 169/54 |
| 5,743,337 | 4/1998 | MacDonald, III | 169/16 |
| 5,794,853 | 8/1998 | Perkins | 239/208 |
| 5,842,526 | 12/1998 | Archer et al. | 169/37 X |
| 5,845,886 | 12/1998 | McCormick . | |

FOREIGN PATENT DOCUMENTS

| | | | |
|---|---|---|---|
| 3919638 C1 | 11/1990 | Germany | 35/68 |

OTHER PUBLICATIONS

FlexHead Industries brochure, "FlexHead Sprinkler".
OC&B Industries brochure, "E–Z Drop Sprinkler".
Tofle Co., Inc., "Adjustable Drop Nipples for Fire Sprinkler Systems".
Electrical Acoustical, "Caddy T–Grid Box Hanger".
A&G Manufacturing Co., Inc.'s brochure entitled "Fasteners, Conduit Supports, T–Bar Hangers", 1983, pp. 1–16.
A&G Manufacturing Co., Inc.'s brochure entitled "Fasteners, Conduit Supports, T–Bar Hangers", 1995, pp. 1–12.
Thomas Industries, Inc.'s brochure entitled "Spring Steel Clips for the Construction Industry", 1985, front page, pp. 38, 39, 42, 43, 44, 60, 61, and back cover.
GB Electrical, Inc.'s brochure entitled "Quality Electrical Products", 1991, pp. 186, 187, 189, 210, 211, and back cover.

*Primary Examiner*—Andres Kashnikow
*Assistant Examiner*—Steven J. Ganey
*Attorney, Agent, or Firm*—Fish & Richardson P.C.

[57] ABSTRACT

A system is provided for maintaining a sprinkler head in a position to allow continued operation during a fire in the event that the support structure for the sprinkler head fails or is otherwise removed. The support system includes a central hub adapted to receive a sprinkler head, a first leg attached to the central hub and having first and second ends. The support system also includes first and second ends having fastening devices adapted to attach the ends to the support structure. The fastening devices are configured to break away from the support structure in the event of support structure failure.

33 Claims, 16 Drawing Sheets

SUPPORT SYSTEM ATTACHMENT MECHANISM FOR FIRE PROTECTION SPRINKLERS

This application is related to co-pending U.S. Application No. 09/227,525 and U.S. Application No. 09/228,083, both filed on Jan. 8, 1999.

The invention relates to a support system for attaching a sprinkler head to a support structure in a ceiling, floor, or wall.

BACKGROUND OF THE INVENTION

A typical automatic fire sprinkler system includes a network of pipes that carry a fire suppression fluid, e.g., water, to each room in the building. Conduit sections carry the fluid from the pipes to sprinkler heads strategically located in different rooms. The position and orientation of each sprinkler head is typically maintained in place by a support mechanism. When the room reaches an elevated temperature due to a fire the sprinkler head is activated allowing a stream of fire suppression fluid to be directed over the intended area of coverage. During operation the fluid pressure at the sprinkler head can reach as high as 175 psi, generating significant back pressure on the sprinkler head's support system. The support mechanism must be capable of holding the sprinkler head securely in place during operation.

SUMMARY OF THE INVENTION

The invention features a system which maintains a sprinkler head in a position for allowing continued operation during a fire in the event that the support structure for the sprinkler head fails or is otherwise removed.

According to one aspect of the invention, a support system includes a central hub adapted to receive a sprinkler head, a first leg attached to the central hub and having first and second ends. The first and second ends include fastening devices adapted to attach the ends to the support structure. The fastening devices are configured to break away from the support structure in the event of support structure failure.

A further aspect of the invention features a support system including a central hub adapted to receive a sprinkler head, a first leg attached to the central hub and having first and second ends. The first and second ends include fastening devices adapted to attach the ends to the support structure. The fastening devices are configured to break away from the first leg in the event of support structure failure.

A further aspect of the invention features a support system including a central hub adapted to receive a sprinkler head, a first leg attached to the central hub and having first and second ends adapted to attach to the support structure. The central hub is configured to break away from the first leg in the event of support structure failure.

A further aspect of the invention features a support system including a central hub including a plate and a sleeve, the sleeve being adapted to receive a sprinkler head. The support system further includes a first leg attached to the central hub and having first and second ends adapted to attach to the support structure. The sleeve is configured to break away from the plate in the event of support structure failure.

Embodiments of these aspects of the invention may include one or more of the following features.

The fastening devices are break away clips. The break away clips include a loose rivet and a punched and bent metal sheet. The support system can further include an auxiliary support mechanism, e.g., a rod, rope, wire, or a chain, attached to the support system.

In all of the above aspects, a sprinkler head, in operation, is capable of providing fire extinguishing fluid, even when the support structure fails due to, for example, damage to the support structure caused by fire, earthquake or other calamity. The sprinkler head is also advantageously maintained in position when the support structure (e.g., ceiling frame) is intentionally or unintentionally removed by workers performing renovations.

Embodiments of these aspects of the invention may include one or more of the following features.

In certain embodiments, a flexible fluid supply hose connected to the sprinkler head allows the sprinkler head to be maintained in position to effectively combat the fire.

In other embodiments, the support system includes an auxiliary support mechanism attached to the support system, such as a rod, a rope, a wire, and a chain to support the sprinkler head when the main support structure is removed.

The fastening devices are break away clips including, for example a loose rivet and a punched and bent metal sheet.

The auxiliary support is particularly well-suited for use with support systems having a second leg, attached to the central hub, and being substantially parallel to the first leg.

The support structure may be of the type having support members forming a rectangular frame. In this case, the first end of the first leg and the second end of the second leg are each adapted to be attached to a first one of the support members of the support structure. The first leg can further include a third end and the second leg can include a fourth end. The first and third ends of the first leg are adapted to attach to a first one of the support members and the second and fourth ends of the second leg are adapted to attach to a second one of the support members, the second one of the plurality of support members, which are parallel to the first one of the support members. The third and fourth legs are attached to the central hub and are substantially perpendicular to the first leg.

The support system further includes a flexible sprinkler assemblage including a flexible conduit, a fitting attached to the flexible conduit, and the sprinkler head attached to the fitting. The central hub includes a plate and a sleeve, the sleeve being adapted to receive the sprinkler head.

These and other features and advantages of the invention will be apparent from the following description of a presently preferred embodiment, and from the claims.

DETAILED DESCRIPTION

Figure 1:
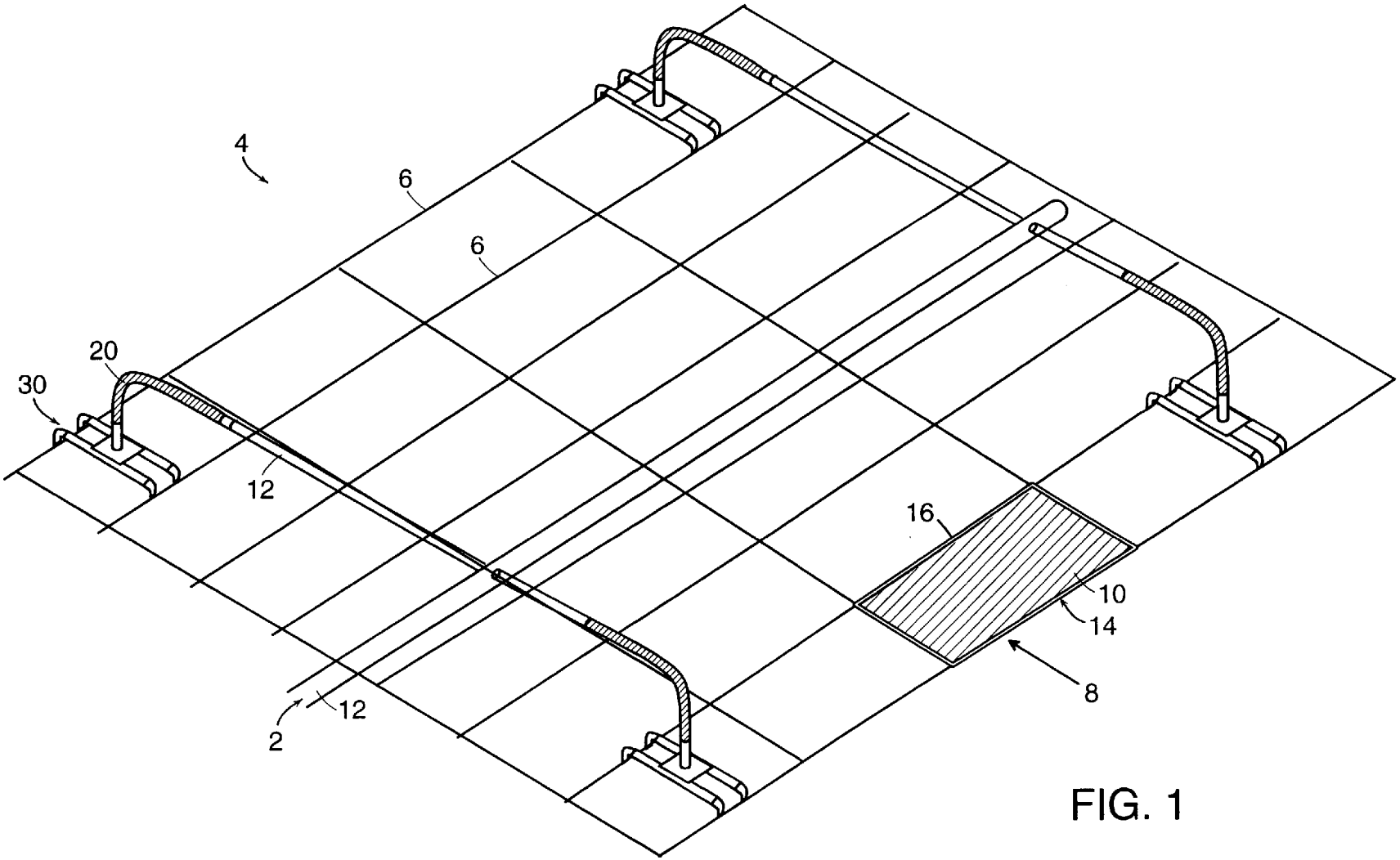
FIG. 1 is a diagrammatic, perspective view of a number of sprinkler support systems, in accordance with the invention, positioned within a suspended ceiling.

With reference to FIG. 1, a sprinkler system 2 includes several support systems 30 mounted within a ceiling 4 having a ceiling frame 6 formed of an array of rectangular frame sections 8. Ceiling frame 6 can be a suspended ceiling for supporting a plurality of decorative panels 10 within rectangular frame sections 8. In order to protect the room from fire, sprinkler system 2 is most commonly located above the ceiling frame 6, but can also reside in a floor or in one or more walls. Support system 30 will effectively support sprinkler heads in any of these locations.

As will be described in greater detail below, each support system 30 secures a sprinkler head 32 (FIG. 2) at a predetermined position within an associated one of rectangular frame sections 8. A flexible conduit 20 carries a fire suppression fluid, e.g., water, from supply pipes 12 to sprinkler head 32. Pipes 12 can be part of a fluid delivery system dedicated to fire suppression, or can also deliver water to other functions (e.g., within the building). When the room reaches elevated temperatures, sprinkler head 32 is activated and a stream of fire suppression fluid is directed into the room to extinguish the fire.

In order to function effectively, sprinkler head 32 must be held firmly in place during operation. Due to the significant back pressure of the fluid flowing therethrough, sprinkler head 32 is subjected to tremendous side, rotational, and torsional forces, which are capable of changing the position of the sprinkler head, thereby causing the fluid to be directed away from the intended target.

Figure 2:
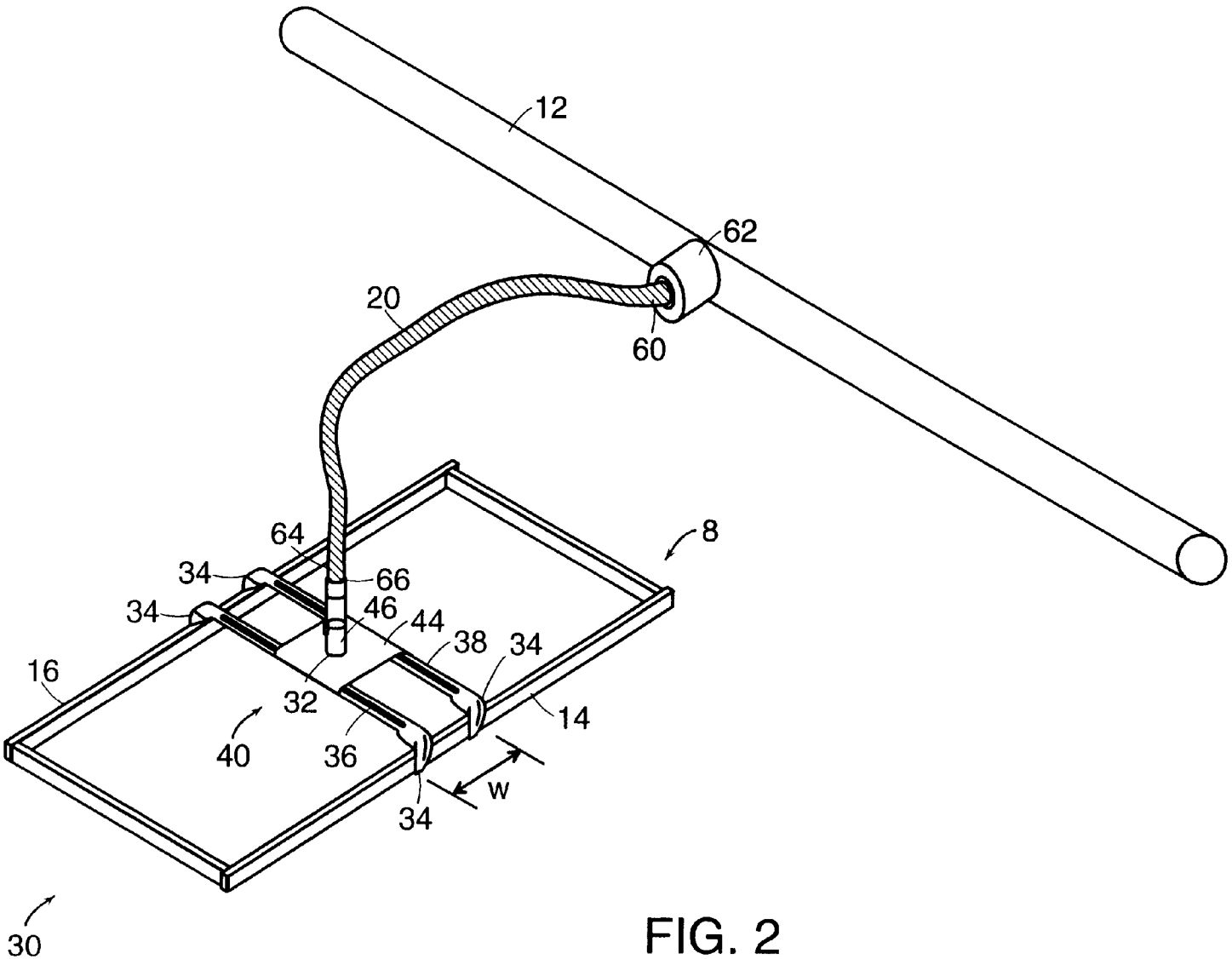
FIG. 2 is a perspective view of one of the support systems of FIG. 1.

Referring to FIG. 2, support system 30 is configured to resist movement of sprinkler head 32 by distributing the forces to four spaced-apart points 34 along the periphery of one of the rectangular frame sections 8. In particular, support system 30 includes two legs 36, 38 and a central hub 40. Each leg is attached to hub 40 and is configured to resist the forces imparted to sprinkler head 32 during its operation. In the embodiment shown in FIG. 2, both legs 36, 38 extend across the width of the rectangular frame section 8 from a frame side 14 to an opposite and parallel frame side 16.

Legs 36, 38, are substantially parallel to each other. The length of the legs, that is, the dimension running between opposite sides 14 and 16 of ceiling frame section 8, is parallel to the ceiling. Legs 36, 30 must be capable of withstanding the back pressure from sprinkler head 32 during operation, and thus their shape and thickness will depend on system requirements, as well as on which of the many sprinkler head designs sprinkler system 2 employs.

Figure 3:
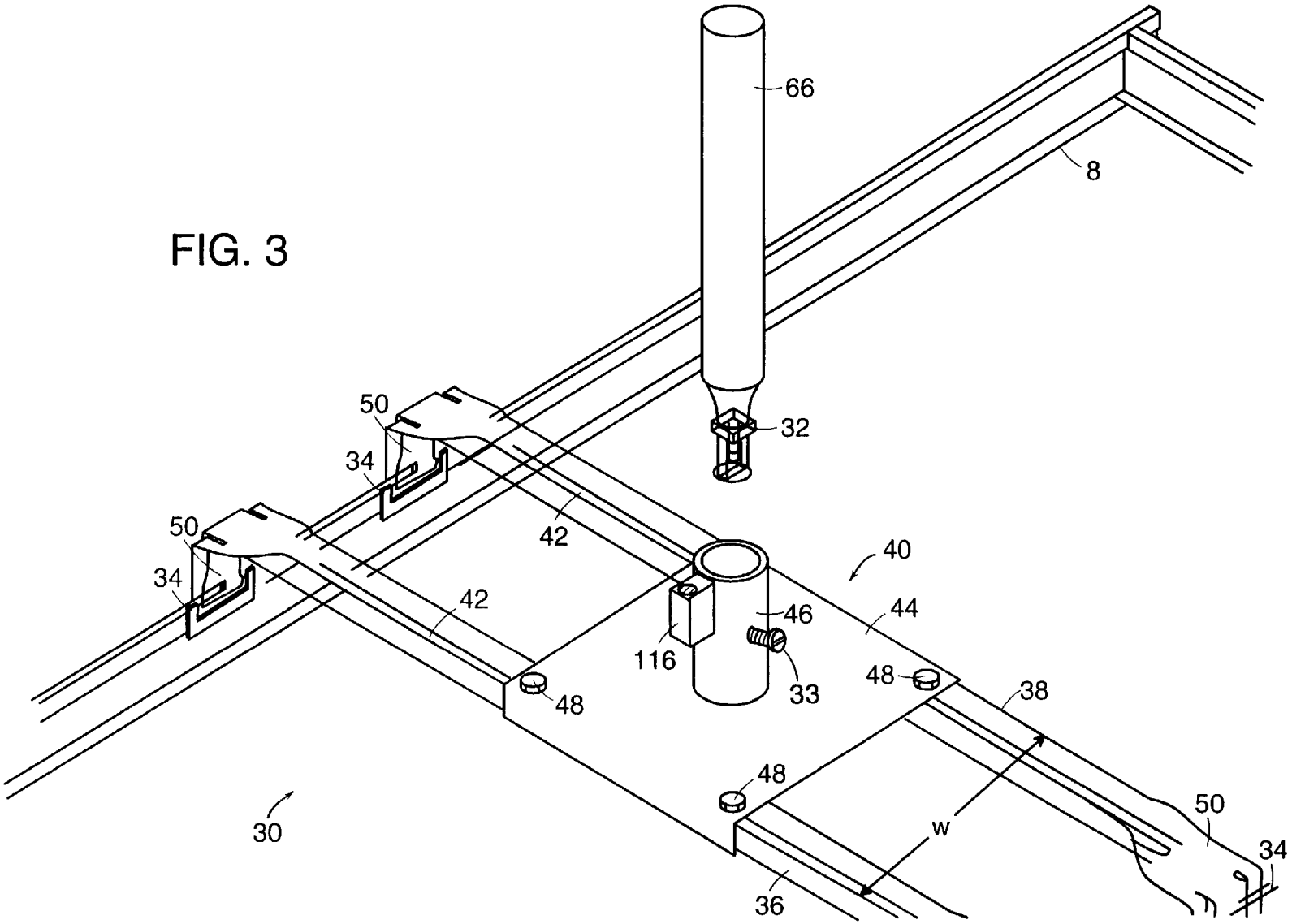
FIG. 3 is a perspective, partially exploded, view of the support system of FIG. 2.

Referring to FIG. 3, each leg 36, 38 is formed as a channel-shaped, one-piece strut having a slot 42 extending along a substantial length of the leg. Central hub 40 includes a plate 44 and a sleeve 46. Plate 44 attaches at one or more points. Leg 36 is attached on an opposite side of plate 44 than leg 38. Plate 44 has a width (w) defining the spacing between legs 36, 38.

Plate 44 can be permanently or slidably attached to legs 36, 38. A permanent attachment enables plate 44 to firmly support sleeve 46 and sprinkler head 32, as well as maintain a space between the two legs 36, 38.

In the embodiment shown in FIG. 3, plate 44 is configured to slide along the length of legs 36, 38 to adjust the position of plate 44 and sprinkler head 32 attached thereto. Plate 44 includes four bolts 48, each of which extends through plate 44 and slot 42 of legs 36, 38. Plate 44 is attached to each leg with two bolts 48. By attaching each of bolts 48 to a nut positioned beneath legs 36, 38, plate 44 is fastened to the legs. If bolts 48 are loosened or removed, plate 44 is freely slidable along the length of legs 36, 38. Once plate 44 is properly positioned, bolts 48 are tightened to the nuts, fixing the plate at that location.

Plate 44 is preferably attached to legs 36, 38 in a manner to maintain the space between the two legs, and to hold them substantially parallel to each other. The space between legs 36, 38 ensures that legs 36, 38 connect to frame section 8 at four distinct points 34, better distributing the forces on support system 30 during sprinkler head operation. As discussed above, during fire suppression operations the water pressure exiting the sprinkler head 32 can reach as high as 175 psi, exerting upward and possible outward force on support system 30. If support system 30 is not sufficiently stable these forces will disconnect it from frame section 8. By using two spaced-apart legs support system 30 distributes the forces to four spaced points, providing a more stable platform. Legs 36, 38 should be spaced-apart far enough that the four points at which the legs connect to ceiling frame section 8 give the bracket proper stability, distributing the back-pressure and preventing sprinkler head 32 from moving or rotating in any direction during sprinkler operation.

Figure 4:
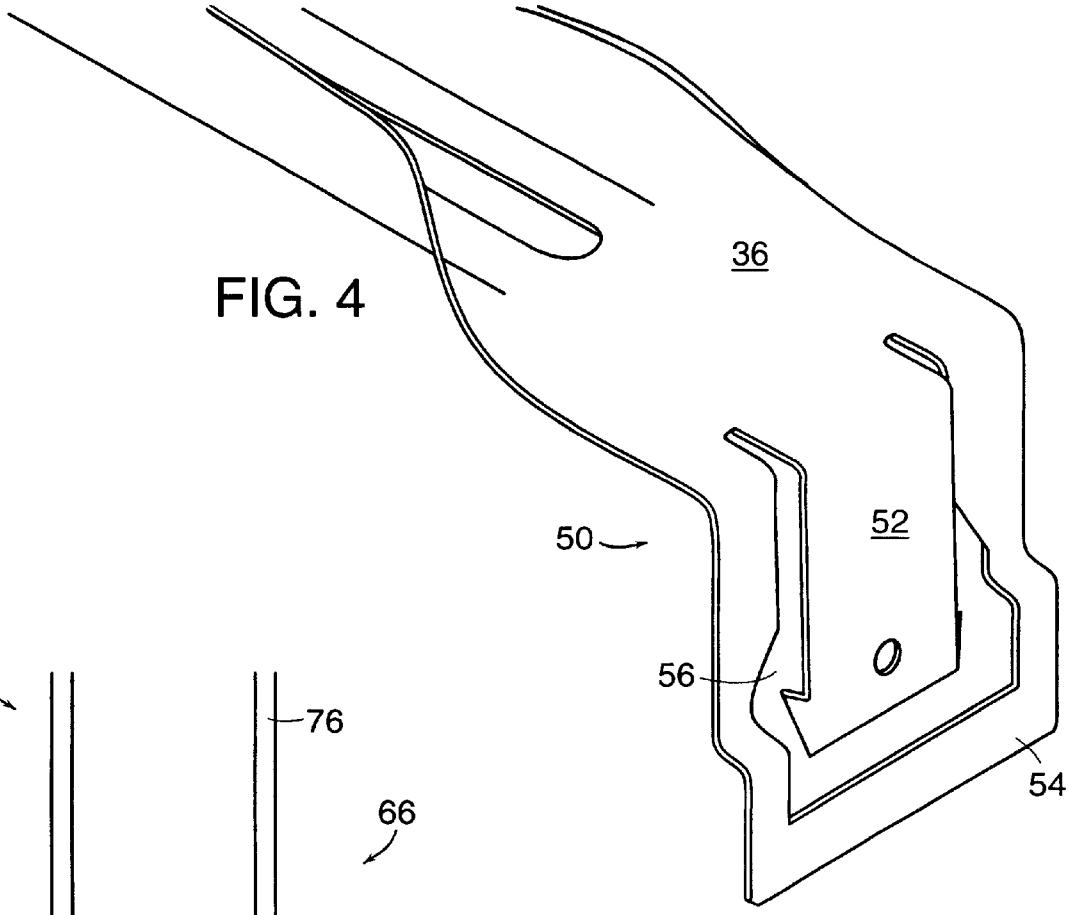
FIG. 4 is a perspective view of an end of a leg of the support system of FIG. 2.

In order to position support system 30, legs 36, 38 have four clips 50 that attach to the four spaced-apart points 34 of rectangular frame 12. As best shown in FIGS. 3 and 4, in one such adjustable embodiment, the ends of legs 36, 38 can be punched and bent to form clip 50. Clip 50 includes a tongue 52 spaced from a seating frame 54, and a gap 56. Tongue 52 serves as a cantilever spring which can be bent away from gap 56 to allow the frame side of frame section 8 to be positioned in the gap. Releasing tongue 52 engages the frame side between the tongue 52 and seating frame 54. This type of clip 50 can be especially useful when the ceiling 4 is a suspended ceiling, which typically uses a grid of T-bar to support decorative panels 10. Clip 50 can be easily slid or relocated on the T-bar to reposition the support system.

Clips 50 at one end of each of legs 36, 38 attaches to frame side 14, while clips 50 on opposite end of legs 36, 38 attach to opposite frame side 16.

Clips 50 can be detached from frame sides 14, 16 and reattached at different points along frame sides 14, 16. Alternatively, clip 50 can be slid along frame sides 14, 16. By these mechanisms, support system 30 can be positioned at any point along frame section 8, and can be moved to a different point if the need to reposition sprinkler head 32 arises. That is, when legs 36, 38 span the width of the frame by connecting to frame sides 14, 16, clips 50 allow legs 36, 38 to be slid along the length of frame sides 14, 16. In addition, clip 50 is designed to slip off of decorative panel 10 in response to a predetermined amount of force. Thus, clip 50 can break away from decorative panel 10 in the event of a ceiling failure.

Sleeve 46 of central hub 40 is secured to plate 44 and is adapted to receive sprinkler head 32. The height of sprinkler head 32 may be adjusted within sleeve 46 by any of the commonly known attachment methods, e.g., by the loosening and tightening of a set screw. If the position of either central hub 40 on legs 36, 38 or sprinkler head 32 in sleeve 46 is adjusted, it is preferable that the connections be securely fastened during installation to prevent any further movement during fire suppression operations.

The mechanisms for adjusting the plate's 44 position on legs 36, 38 and the sprinkler head's 32 position can be combined with the slidable clip 50 mechanisms, as described above, allowing the contractor installing the support system to position sprinkler head 32 at any point within frame section 8. The ability to easily relocate or position support system 30, especially when combined with flexible conduit 20, provides installers with the maximum amount of flexibility for positioning sprinkler head 32 without additional plumbing work. This is especially advantageous in renovations or remodeling operations, where circumstances frequently require that sprinkler heads 32 be simply moved a few feet.

In operation, flexible conduit 20 delivers the fire suppression fluid from pipe 12 to sprinkler head 32. Flexible conduit 20 is constructed of stainless steel with a braided sleeve. Because conduit 20 is flexible numerous benefits are provided in many applications. For example, flexible conduit 20 eliminates elbows and additional pipe sections generally required to properly position sprinkler head 32. As a result, the number of parts as well as the time and labor needed for installing the system is reduced. Flexible conduit 20 allows the contractor to easily move sprinkler drops during renovations. Further, flexible conduit 20 reduces the likelihood of leakage at joints, allows easy adjustment of sprinkler head 32 position without additional plumbing work, allows a greater latitude in positioning sprinkler head 32 to aesthetically pleasing locations, and helps reduce the possibility of damage to the sprinkler system 2 during seismic activity, fire, or renovation.

An end 60 of conduit 20 is attached to pipe 12 by a rigid fitting 62. Rigid fitting 62 can be any one or more commonly known methods of connecting to pipe, including, for example, threaded, grooved, socket welded, socket glued, regular welded, pressed fit, compression fitting, or a flare fitting connections. In addition, an adaptor can be used to attach fitting 62 to conduit 20. The method selected will depend on the material used for conduit 20. Rigid fitting 62 can be made of any material, but the material used will generally depend on the material used for conduit 20.

A second end 64 of flexible conduit 20 is attached to a fitting 66 which is in turn attached to sprinkler head 32 by any of the above methods. As with fitting 62, the type of connection and the material used for fitting 66 can depend on the material used for conduit 20. Fitting 66 can be a rigid, substantially cylindrical tube, e.g., a reducing fitting.

Figure 5:
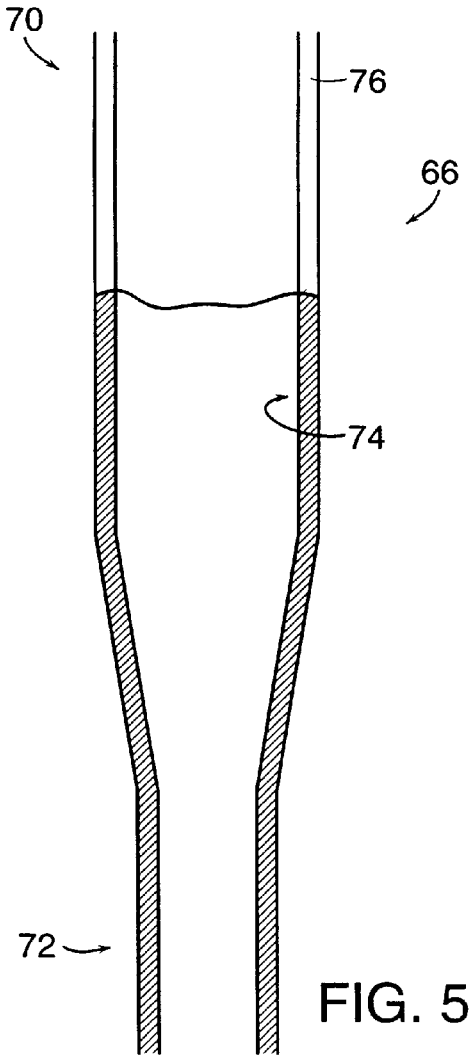
FIG. 5 is a cross-sectional side view of a fitting.

As shown in FIG. 5, fitting 66 is a swaged fitting as described in U.S. Pat. No. 5,794,853, incorporated herein by reference. Fitting 66 can include a conduit end 70, a sprinkler head end 72 and an inner surface 74. Conduit end 70 includes an external surface to receive conduit 20. Sprinkler head end 72 is internally threaded on inner surface 74 to receive sprinkler head 32.

Sprinkler head 32 can be any of the sprinkler head designs commonly used in the fire protection industry. Depending on the dimensions of sprinkler head 32 and the dimensions of flexible conduit 20 an adapter (not shown) may be required to connect fitting 66 and sprinkler head 32. The type of connection between fitting 66 and the sprinkler head 32 will depend on the material used for fitting 66.

Figure 6:
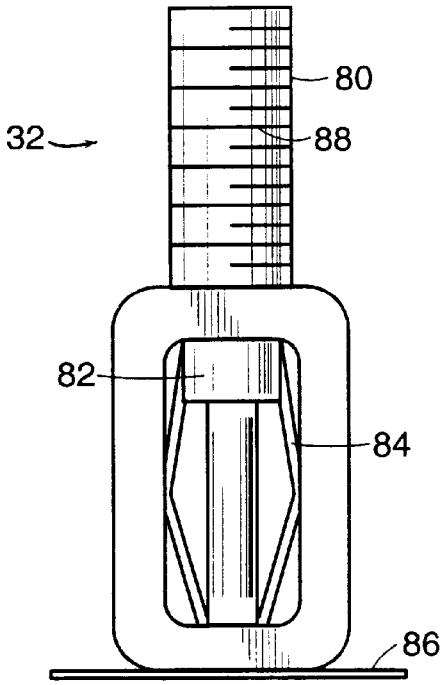
FIG. 6 is a side view of a sprinkler head.

For example, with reference to FIG. 6, sprinkler head 32 includes a length of cylindrical pipe 80 having a fluid passage obstructed by a plug 82. Plug 82 is held in place by fusible links 84, which are fabricated to melt within a specific temperature range, e.g., between 130° F. and 212° F. Alternative methods of holding plug 82 in place include a bottle of glycerin that expands when heated to break the vile. When links 84 break, plug 82 is released from pipe 80 by the pressure of the sprinkler system fluid, and the fluid is scattered over a wide area by a dispersion device 86. The outer surface of pipe 80 includes threads 88 for connection to fitting 66.

In certain situations, a support structure can either fail, that is, fall down, or may be removed, such as during renovations. For example, during a fire or an earthquake all or parts of ceiling frame 6 can collapse. Similarly, a crew removing ceiling frame 6 during renovations may not always take care to separate the sprinkler system from frame section 8 before it is torn down. In addition, if it is suspected that a fire is located above a suspended ceiling, a suspended ceiling will be torn down. In many locations local codes may require that the sprinkler system continue to operate when the ceiling is torn down.

If in these situations support system 30 is rigidly or permanently attached to frame section 8, then support system 30 will fall or be removed with frame section 8. The result will be significant damage to sprinkler system 2, as well as damage to the building from the inevitable water leaks. Further, if, due to this damage, sprinkler system 2 fails to operate during a fire or an earthquake the building may be destroyed.

On the other hand, sprinkler system 2 will not be damaged or fail to operate if support system 30 includes a mechanism capable of separating the support system 30 from frame section 8 when frame section 8 fails. In this case, support system 30 can hang from a building component. Alternatively, as described in further detail below, an auxiliary support mechanism such as a rod, chain, wire, or rope, attached to the building component may continue to support system 30.

Figure 7A:
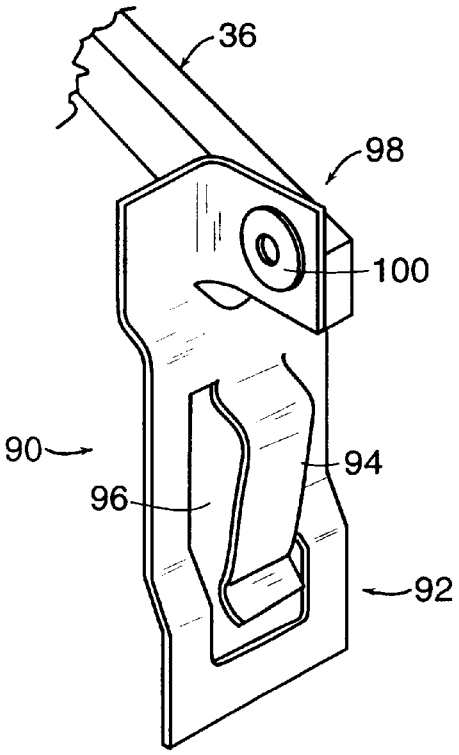
FIG. 7A is a perspective view of an embodiment of a clip attached to an end of a leg of the support system.
Figure 7B:
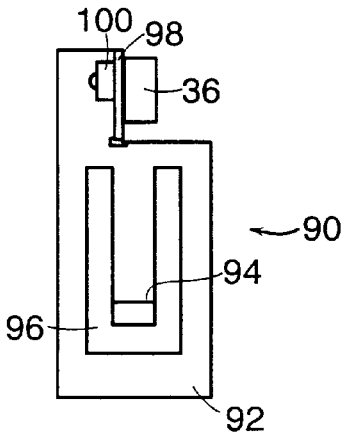
FIG. 7B is a side view of the clip of FIG. 7A.

One separating mechanism suitable for use with support system 30 is a break away clip 90, as shown in FIGS. 7A and 7B. Leg 36 can be attached to frame section 8 by break away clip 90. Break away clip 90 is formed with a metal sheet 92, e.g., spring steel, that has been punched and bent as described above in conjunction with FIG. 4. Break away clip 90 includes a tongue 94, a gap 96 and metal sheet 92. Break away clip 90 is attached to leg 36 (or 38) at a joint 98 by a loose rivet 100. A break away embodiment is especially useful when combined with the auxiliary support mechanism, which can hold the support system in place during support structure failure. Joint 98 is constructed such that under a predetermined amount of force, clip 90 breaks free from the leg allowing support system 30 to remain held in place by the auxiliary support mechanism in the event of a support structure failure. This break away action allows the sprinkler system to continue operation during a support structure failure. Further, loose rivet 100 allows flexibility, increasing the ease of installation.

In addition to the break away clip mechanism, sprinkler system 2 can be protected from support structure failure by other mechanisms, including clip 50 (FIGS. 3 and 4) separating from frame section 8, clip 50 separating from legs 36, 38, central hub 40 separating from legs 36, 38, or sleeve 46 separating from central hub 40.

In other situations a non-break away system can have (as shown in FIGS. 3 and 4) advantages. For instance, in geographic areas that experience frequent or significant seismic activity, a non-break away system may be preferred over a break away system.

Other embodiments are within the scope of the claims.

For example, support system 30 can attach to any manner of support structure in a ceiling, wall, or floor. As described above, support system 30 can attach to a suspended ceiling. Alternatively, support system 30 can attach directly to a building structural member, such as, for example, wood joists and studs or another building component. Support system 30 can be attached to the building structural member, e.g., a concrete ceiling above a suspended ceiling by changing the type of the connector to a concrete drop in anchor. A lengthened fitting can then be used to extend the sprinkler head to the suitable location in the suspended ceiling tile.

Figure 8:
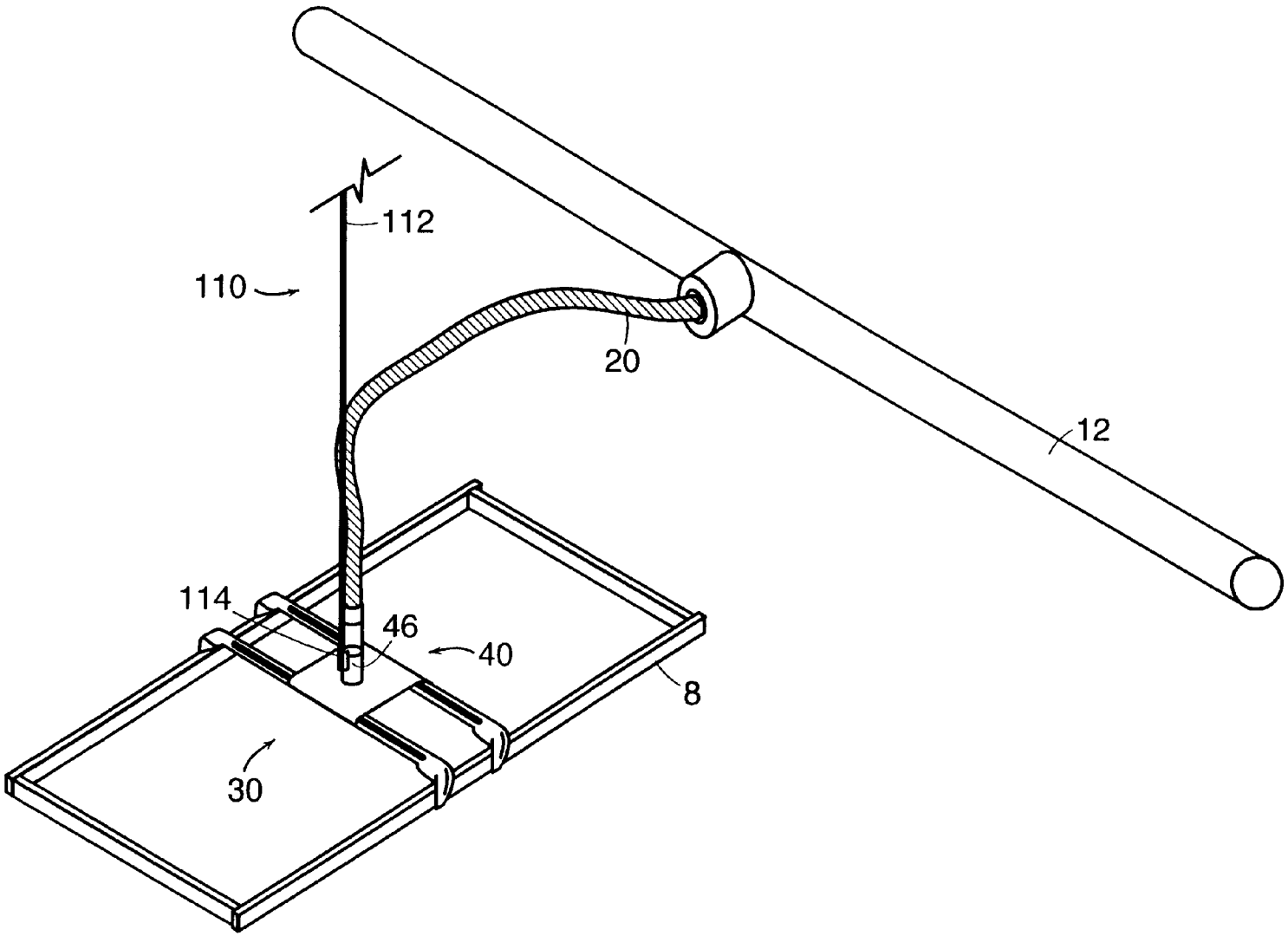
FIG. 8 is a perspective view of an alternative embodiment of the support system including a rod.

As shown in FIG. 8, support system 30 can include a rod 110. Rod 110 is designed to perform two functions. First, rod 110 helps hold support system 30 in place by resisting the back pressure and twisting forces generated during sprinkler head operation. Second, in the event of support structure failure, as described above, support system 30 will break away from the support structure and hang from rod 110, enabling support system 30 to remain in position and continue to provide fire protection.

To provide these advantages, an upper portion 112 of rod 110 is connected to a building component (not shown) such as an I-beam, pipe, concrete wall, the ceiling, or other structural support, by a connection device (not shown). The connection device can be a c-clamp, concrete drop in anchor, nail, lag screw or other connection mechanism. A lower portion 114 of rod 110 can be attached to support system 30, at, for example, central hub 40, e.g., at sleeve 46. Rod 110 can also attach to the flexible sprinkler assemblage, described below.

Rod 110 can be attached to sleeve 46 by welding, by screwing rod 110 into a hole drilled into sleeve 46, or by any other commonly known attachment mechanism. For example, as shown in FIG. 3, a mounting block 116 can be affixed, e.g., by welding, to sleeve 46. Rod 110 is screwed into internal threads within mounting block 116. Alternatively, a channel may be located on plate 44, and rod 110 may be located at any point on the channel. This system has the advantage of easy adjustment of the rod's length and position.

Figure 9:
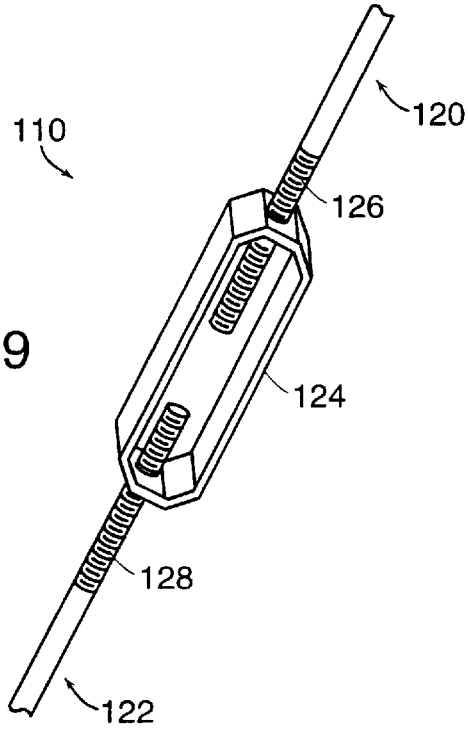
FIG. 9 is a perspective view of an alternative embodiment of the rod of FIG. 8.

The length required for rod 110 depends on the distance between support system 30 and the building component to which rod 110 is attached. Rod 110 must be long enough to reach from the support assembly to the building component. The distance between the best location for a sprinkler head and the nearest building component will vary widely. As a result, for many buildings it can prove difficult or simply unfeasible to predetermine the length of rod needed for each support system 30. To solve this difficulty, rods of predetermined lengths can be provided alongside a mechanism for adjusting their length. One such mechanism is to provide a threaded hole at the point rod 110 connects to either the support system 30 or to the building component. Rod 110 can be threaded through this hole in varying amounts, to increase or decrease the available length of rod 110. In another embodiment, shown in FIG. 9, rod 110 can consist of an upper rod 120, a lower rod 122, and a turnbuckle 124. Upper rod 120 and lower rod 122 both have threaded ends 126, 128, which are threaded into matching internal threads on turnbuckle 124. The turnbuckle is turned in a first direction to tighten the rod and decrease the available length, and turned in a second direction to loosen the rod and increase the available length.

Rod 110 can be constructed from numerous materials, including but not limited to stainless steel, other steels, rubbers, plastics, polymers, ferrous metals, non ferrous metals, polycarbonates, or any combination thereof. For example, rod 110 can be a standard steel threaded plumbing rod.

Figure 10:
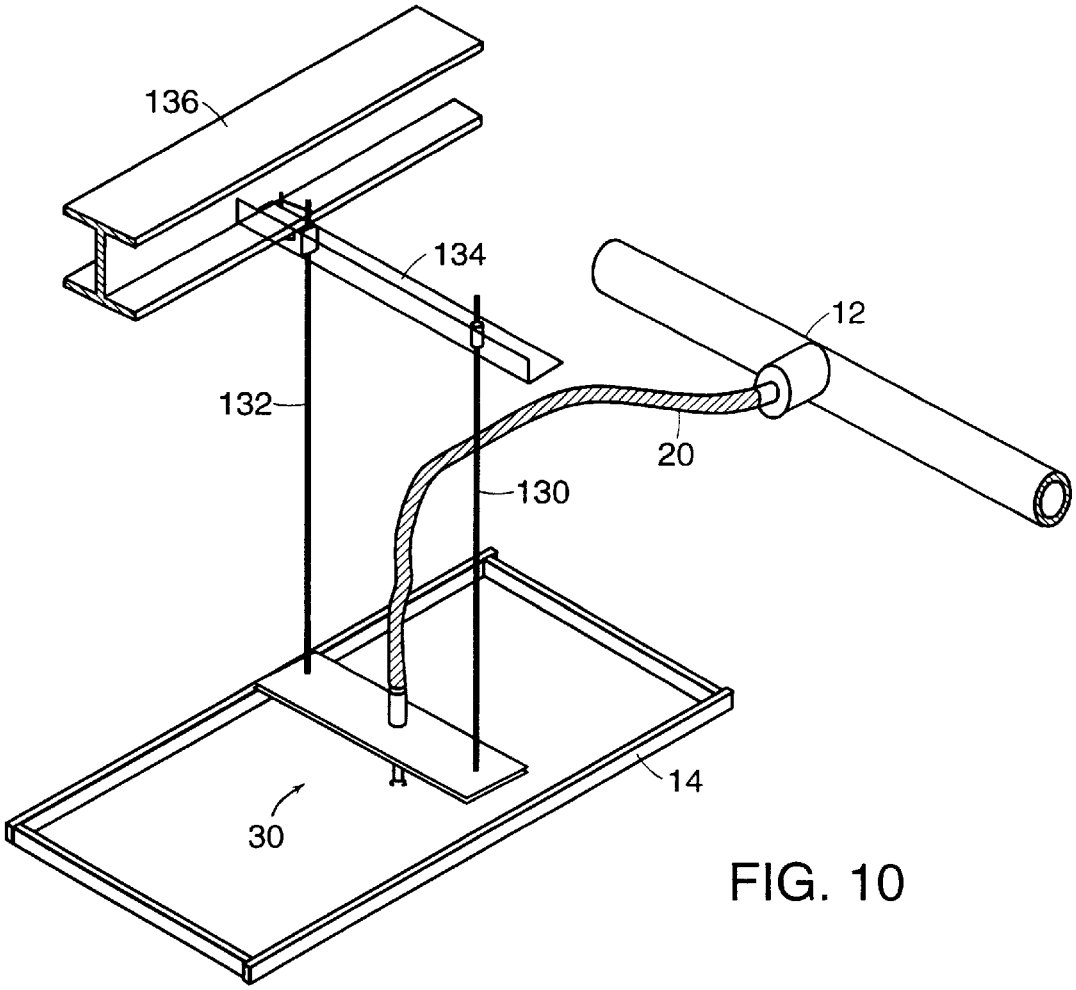
FIG. 10 is a perspective view of an alternative embodiment of the support system.

In another embodiment, as shown in FIG. 10, a pair of rods 130, 132 can be used to provide additional support. Both rods can be connected to the central hub 40, as shown in FIG. 10, or they may be connected elsewhere, to same or different locations. Similarly rods 130, 132 may be connected to the same or to different building components by the same or different connection device. Alternatively, a support 134 can be attached to a building component 136, e.g., by a c-clamp. The two rods 130, 132 can be attached to support 134 and extend to support system 30.

Alternatives to a rod include a chain, wire or rope, all of which can be attached to support system 30. These devices will similarly prevent support system 30 from falling during support structure failure. Further, in locations that experience frequent seismic events, a rod will transmit any shocks or vibrations directly from the building component to the support system. The more flexible devices will cushion the vibrations.

Figure 11:
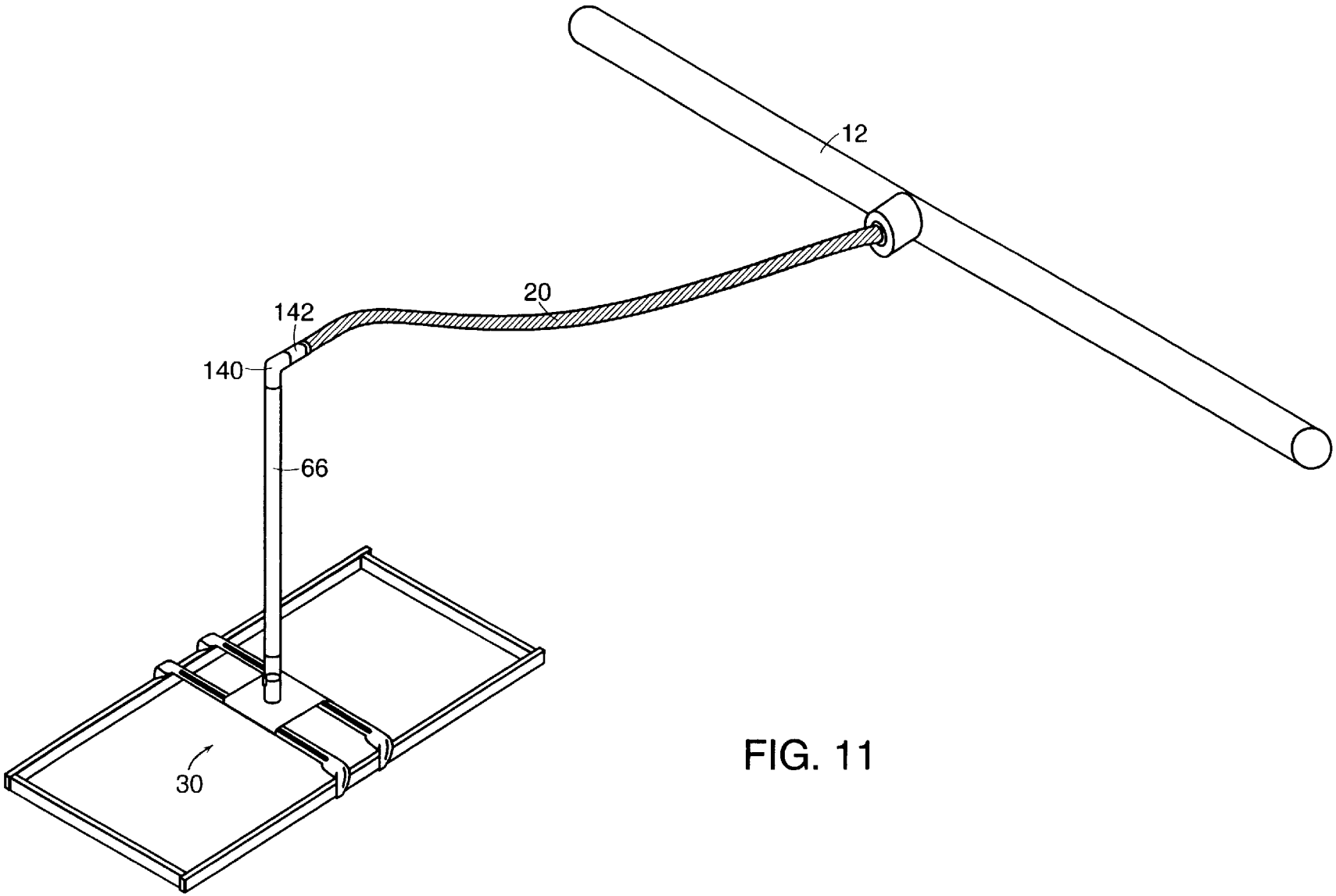
FIG. 11 is a perspective view of a sprinkler support system having an alternative embodiment of a fitting.

Alternative embodiments of fitting 66 can be used with support system 30. Referring to FIG. 5, inner surface 74 of fitting 66 can be any shape so long as water or fluid is conveyed to sprinkler head 32. Inner surface 74 is funnel shaped in FIG. 5. In other embodiments, inner surface 74 may be, for example, cylindrical, or frustoconical. Further, as shown in FIG. 11, fitting 66 can be lengthened and include a 90° bend 140, and a rigid pipe 142. Any angle can be used for bend 140, depending on system requirements.

Various methods of connecting fitting 66 to sprinkler head 32 and conduit 20 can also be used with support system 30, including groove connections, press fittings, compression fittings, socket fittings, and flare fittings. For example, in the case of grooved connections the grooves can be on the inner or outer surfaces of the fitting. The conduit end and sprinkler head end grooves can be on the same surface, e.g., the outer surface, or they can be on different surfaces.

Fitting 66 can be formed from stainless steel, other steels, rubbers, plastics, polymers, ferrous metals, non ferrous metals, polycarbonates, or any combination thereof. Its configuration depends on the type of conduit, the type of sprinkler head, the method by which the conduit and sprinkler heads are attached to the fitting, and the materials used.

With reference to FIG. 2, legs 36, 38 can extend between either pairs of opposing frame sides. That is, legs 36, 38 can span between frame sides 14 and 16, or legs 36, 38 can extend between the other two frame sides.

As noted above the length of legs 36, 38 can be parallel to the plane of the ceiling 4. In alternative embodiments, part or all of the legs may have an upward incline from the connection to frame section 8 towards central hub 40, forming a inverted V shape. Numerous other leg designs are within the scope of the invention and claims.

In another embodiment, legs 36, 38 can consist of a combination of parallel portions and angled portions. For example, center portions of legs 36, 38 can be parallel to each other, and outer portions of both legs can be angled away from each other. This design has the advantage of increasing the distance between the four distinct points 34 at which ends 50 of legs 36, 38 attach to frame section 8, better distributing the forces on support system 30 during sprinkler head operation. At the same time central hub 40 remains relatively small and compact because the distance between the center portions of legs 36, 38 is smaller than the distance between the outer portions.

Figure 12:
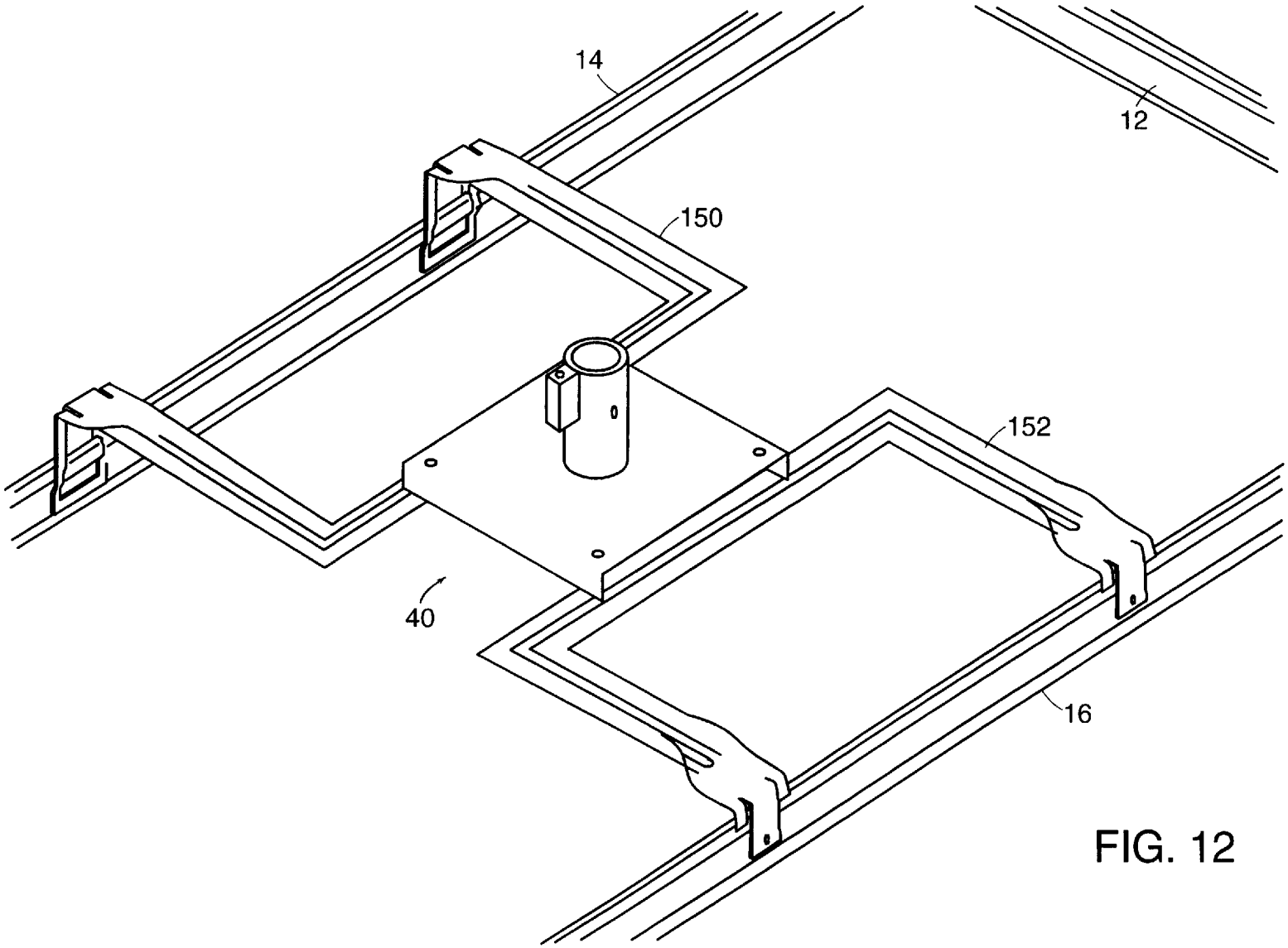
FIG. 12 is a perspective view of an alternative embodiment of the support system.

Alternatively, as shown in FIG. 12, each leg can be U shaped and connect to the same frame side at two locations. For example, leg 150 attaches to frame side 14 twice, while leg 152 attaches to the opposite frame side 16.

Figure 13:
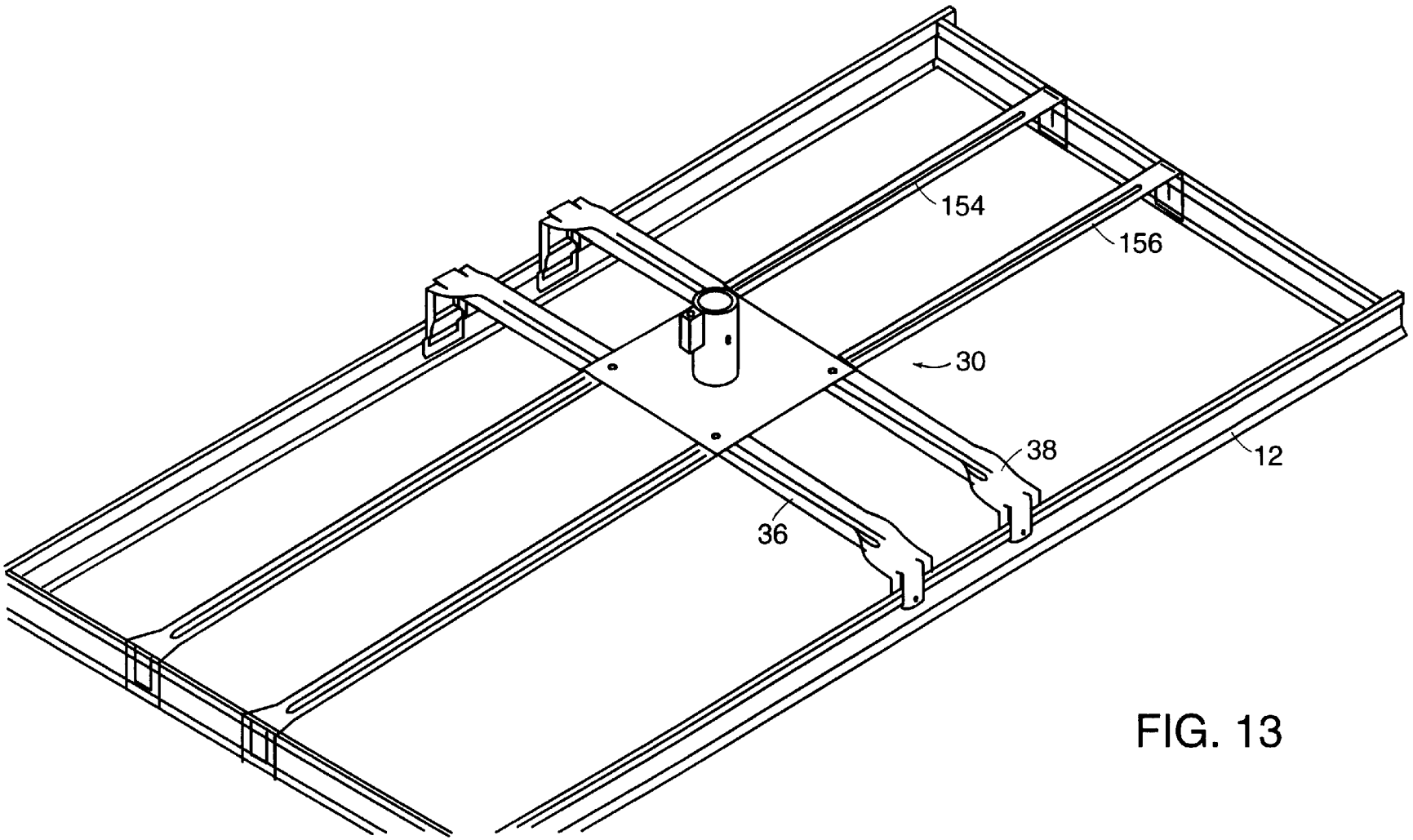
FIG. 13 is a perspective view of an alternative embodiment of the support system.

Support system 30 can use three or more legs to provide additional support to sprinkler head 32. As shown in FIG. 13, support system 30 can use four legs, for example. A third leg 154 and a fourth leg 156 can be perpendicular to legs 36, 38, as shown, or can take any other orientation.

Legs 36, 38 may be constructed of nearly any material, including, but not limited, to stainless steel, other steels, rubbers, plastics, polymers, ferrous metals, non ferrous metals, polycarbonates, or any combination thereof. Preferably the materials used for the support system and the flexible sprinkler assemblage are nonburnable.

In addition to the clips mentioned above, different embodiments utilize different fastening devices for securing legs 36, 38 to frame section 8. The specific fastening device will depend on what building component the support system 30 must be attached to, and include all known attachment methods known in the art. Fastening devices include nails, other clips, bolts, screws, slotted connections, tab and slot connections, and other connection styles known in the art.

For example, the members of suspended ceiling support structures generally include slots in the frame sections to accommodate other cross members of the support structure. The fastening device can be one or more tabs attached to one or more legs (or to the plate, for example) that are inserted into the slot and bent over to secure the tabs.

Sprinkler head 32, fitting 66 and conduit 20 can be pre-connected, either by the contractor while on the ground, or by the manufacturer at the factory, and provided as a flexible sprinkler assemblage. A flexible sprinkler assemblage has the added advantage that the connections between conduit 20, fitting 66, and sprinkler head 32 can be tested for leaks before installation.

It is generally desirable that all of the sprinkler heads in a room be arranged in an aesthetically pleasing manner, such as in a straight line. It can also be desirable for the orientation of the sprinkler heads to be uniform, with the dispersion devices rotated to a uniform position. To gain uniformity a mark can be added to the flexible conduit before the sprinkler head is fastened within the support system. The mark indicates the relative orientation of the dispersion device. During installation the mark is positioned relative to the central hub, which can include a corresponding mark. The mark can be made during installation, or it can be provided as part of the flexible sprinkler assemblage or the support system.

Other embodiments are contemplated for central hub 40 as well. Plate 44 and sleeve 46 can be rigidly connected by any known connection method, e.g., by welding. However, if plate 44 and sleeve 46 are permanently and rigidly connected, the contractor may need to thread sprinkler head 32 and fitting 66 through sleeve 46 while the sleeve is connected to the more bulky support system 30. Further, if the contractor connects the conduit to the pipes before the sprinkler head is threaded through sleeve 46, then sleeve 46 should be formed wide enough to accommodate the sprinkler head, the fitting, and an escutcheon. The escutcheon is a decorative plate that hides the hole cut in the decorative panel to accommodate the sprinkler head.

Installation is much simpler if sleeve 46 is removable from plate 44. As the operation generally takes place while the contractor is on a ladder or in a ceiling, the smaller the unit he must manipulate to connect conduit 20 to the pipe, the quicker he will be able to work.

Figure 14:
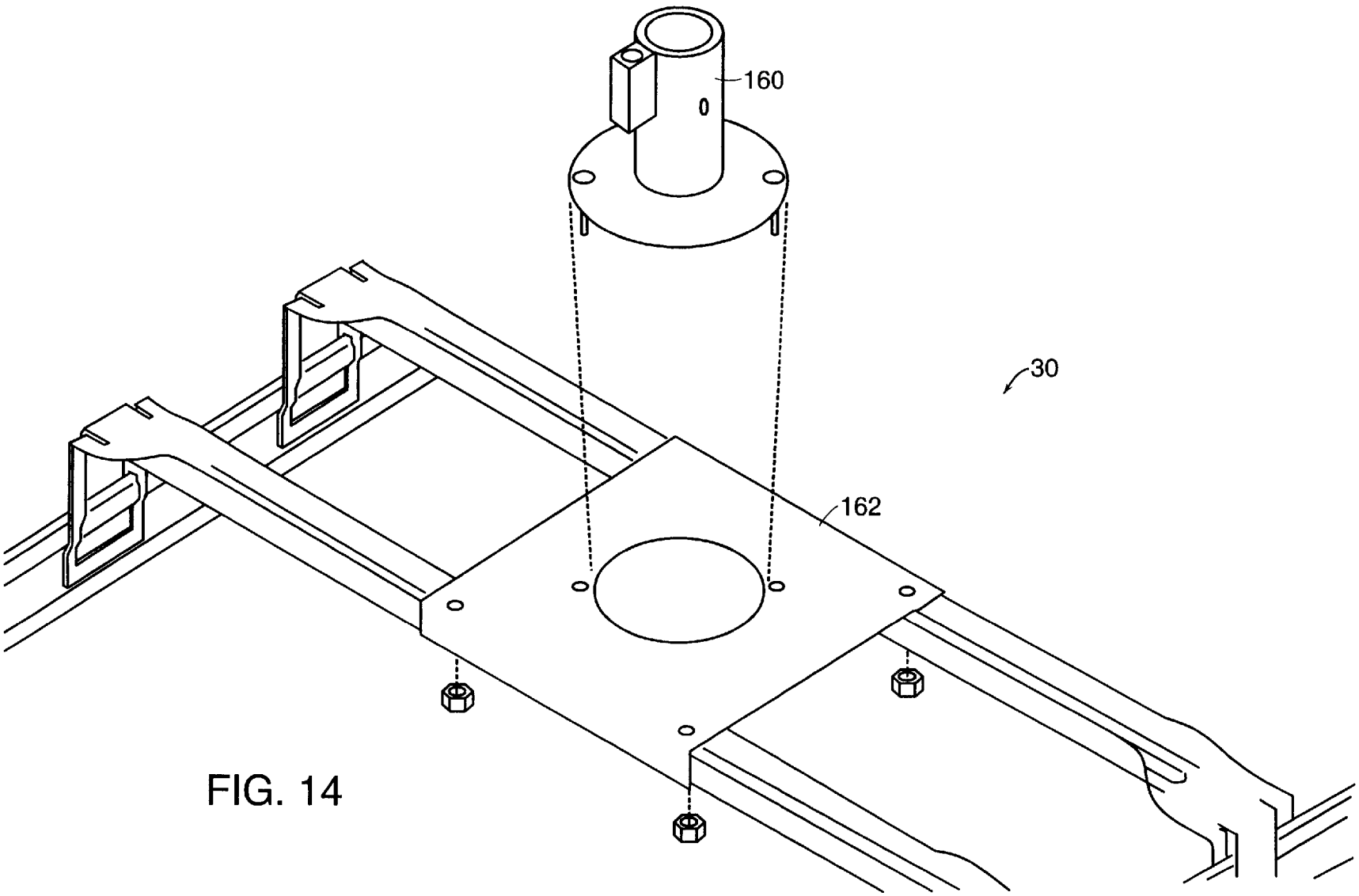
FIG. 14 is a perspective view, partially exploded, of an alternative embodiment of the central hub.
Figure 15:
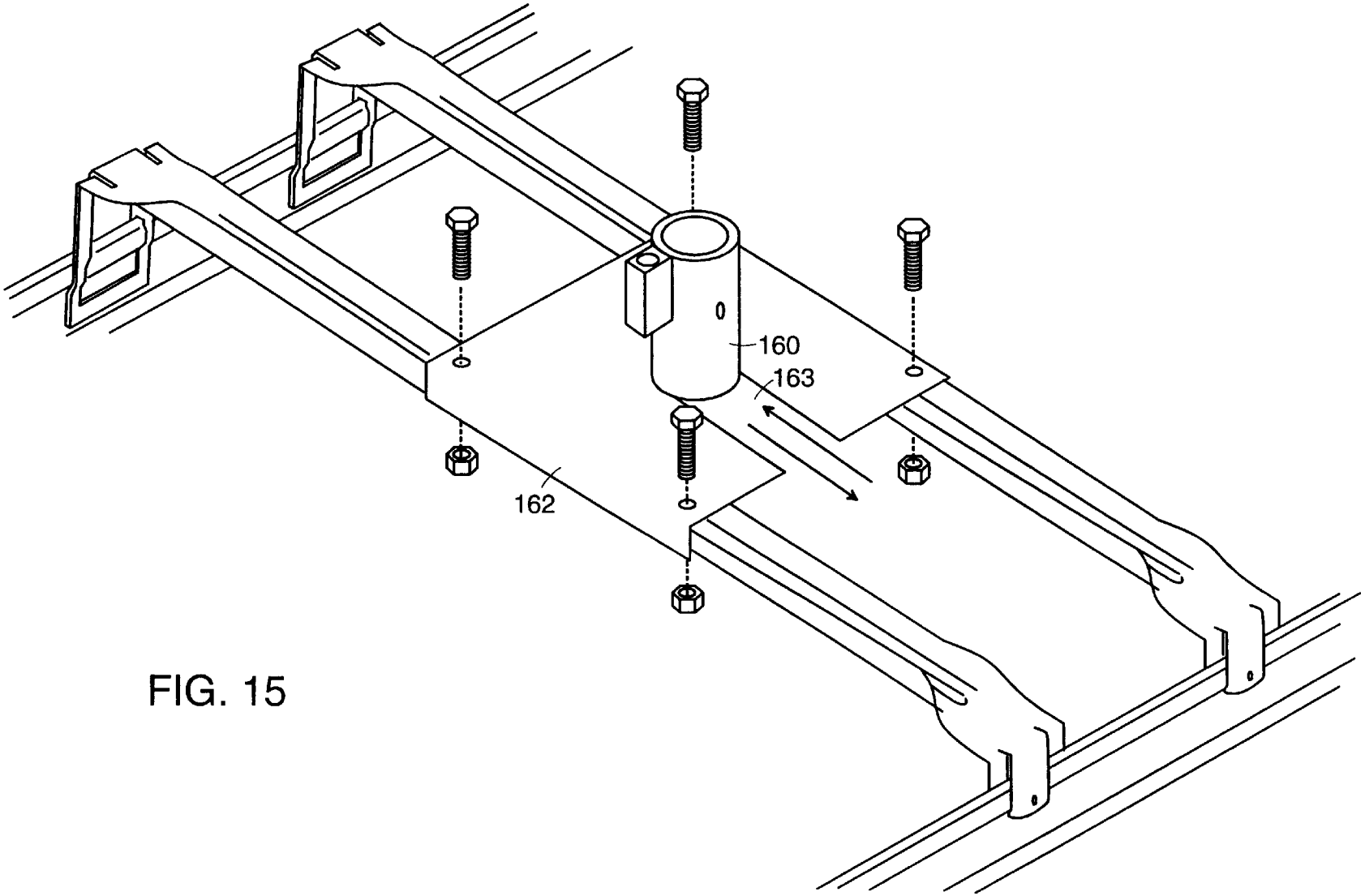
FIG. 15 is a perspective view, partially exploded, of an alternative embodiment of the central hub.

FIG. 14 demonstrates one embodiment of a removable sleeve 160. This embodiment allows the same model of a plate 162 and support assembly 30 to be capable of supporting widely different sizes and shapes of sprinkler heads 32. Various connection mechanisms are contemplated for connecting removable sleeve 160 to plate 162. Sleeve 160 can simply be bolted or screwed on top of plate 162. As shown in FIG. 15, a channel 163 may be provided within plate 162, with sleeve 160 slid within the channel.

Figure 16:
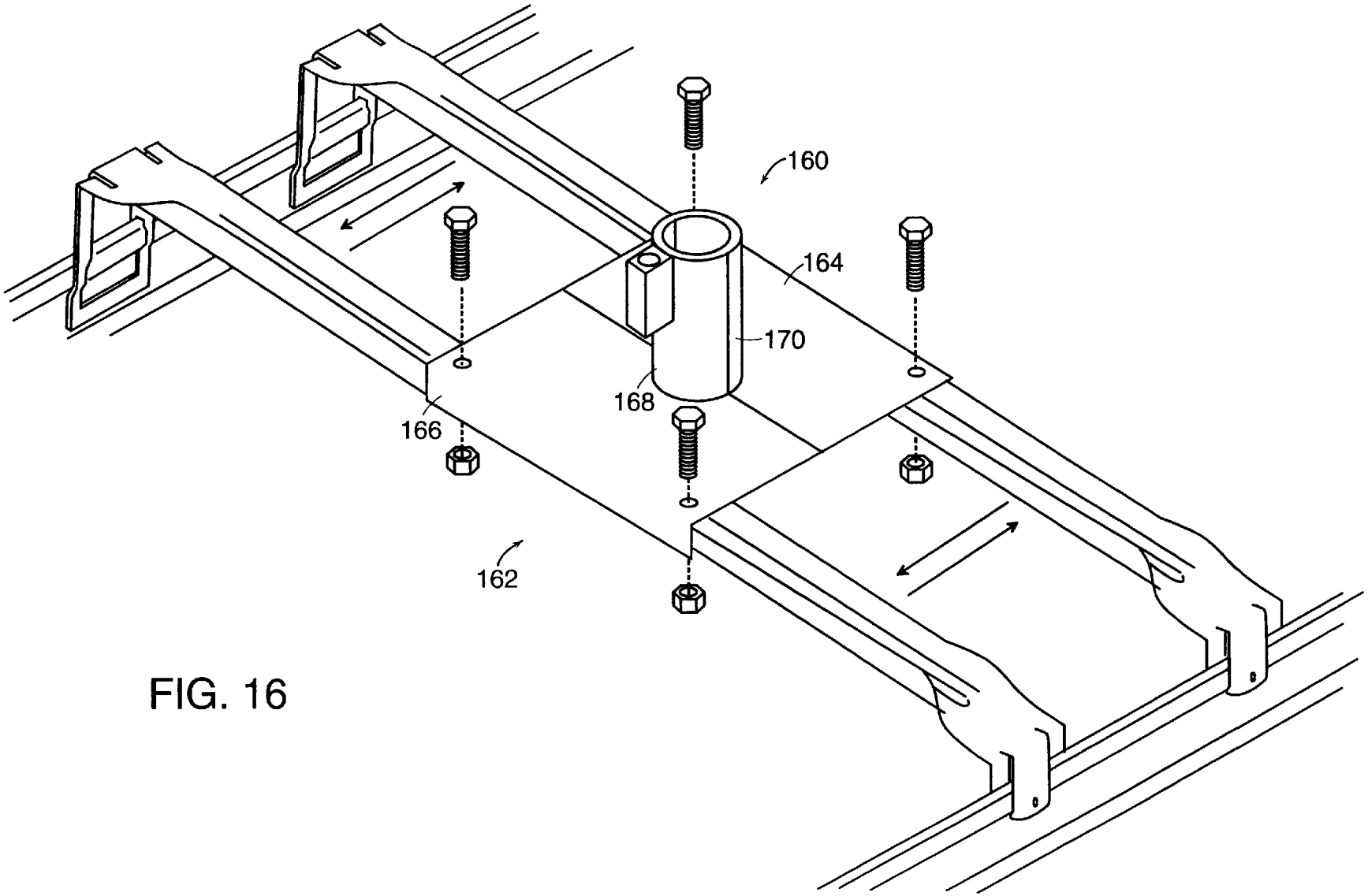
FIG. 16 is a perspective view, partially exploded, of an alternative embodiment of the central hub.

As shown in FIG. 16, a two part central hub can also be constructed by splitting plate 162 and sleeve 160 into two plate sections, 164 and 166, and two sleeve sections, 168 and 170. A hinge (not shown) connects the two plate sections, allowing the central hub to swing open to receive sprinkler head 32, and then to swing shut to hold the sprinkler head 32 in place. Alternatively, just plate 162 may be split into two sections and hinged. The relative orientation of the hinge can be parallel to the legs or transverse to them.

Figure 17:
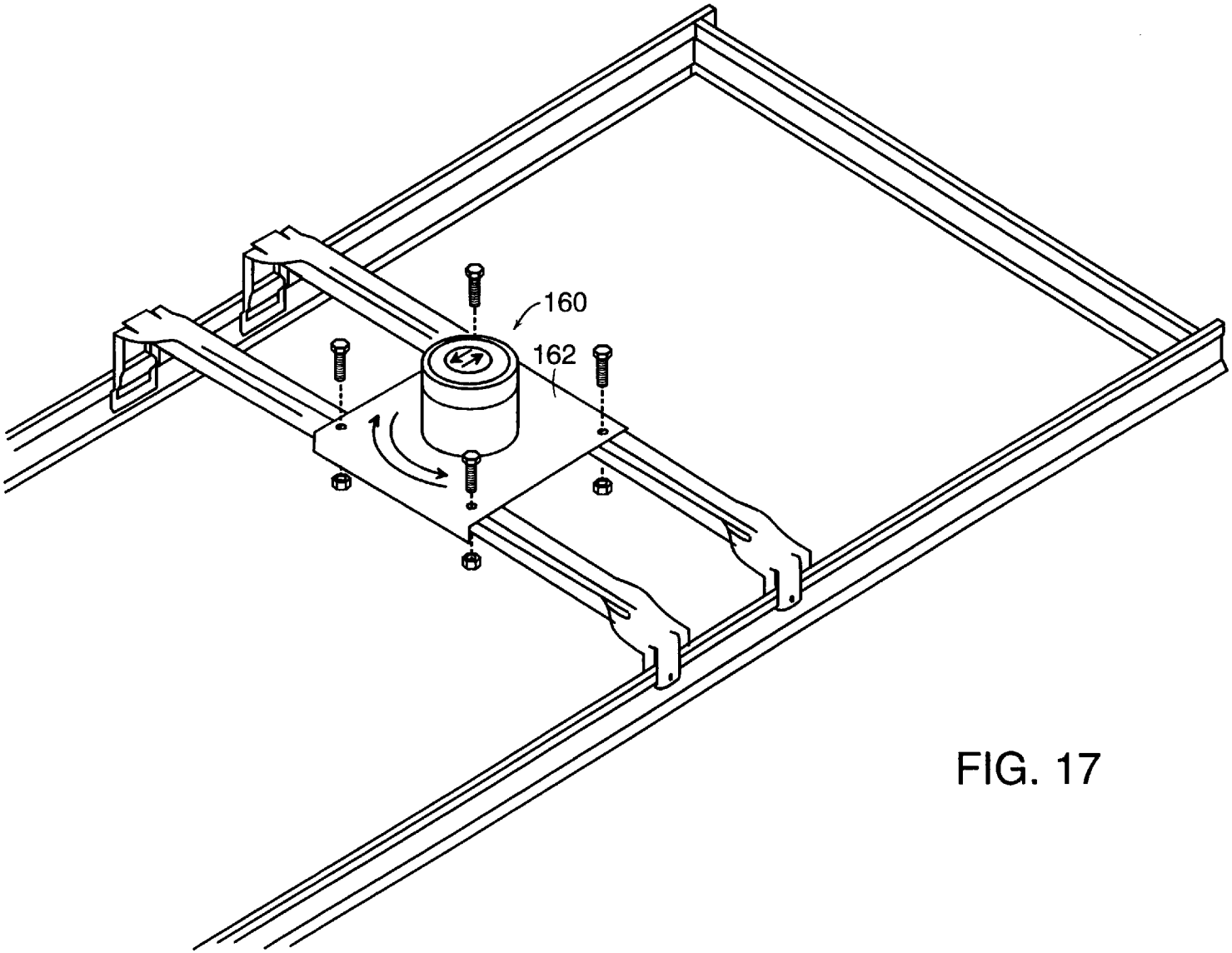
FIG. 17 is a perspective view, partially exploded, of an alternative embodiment of the central hub.

With reference to FIG. 17, sleeve 160 can comprise a telescoping sleeve. In this embodiment sleeve 160 is rotated in one direction to open its center. While open, sprinkler head 32 is inserted and positioned to the proper height. Once sprinkler head 32 is in place sleeve 160 is rotated in the opposite direction to close it and fasten sprinkler head 32 in place.

Figure 18:
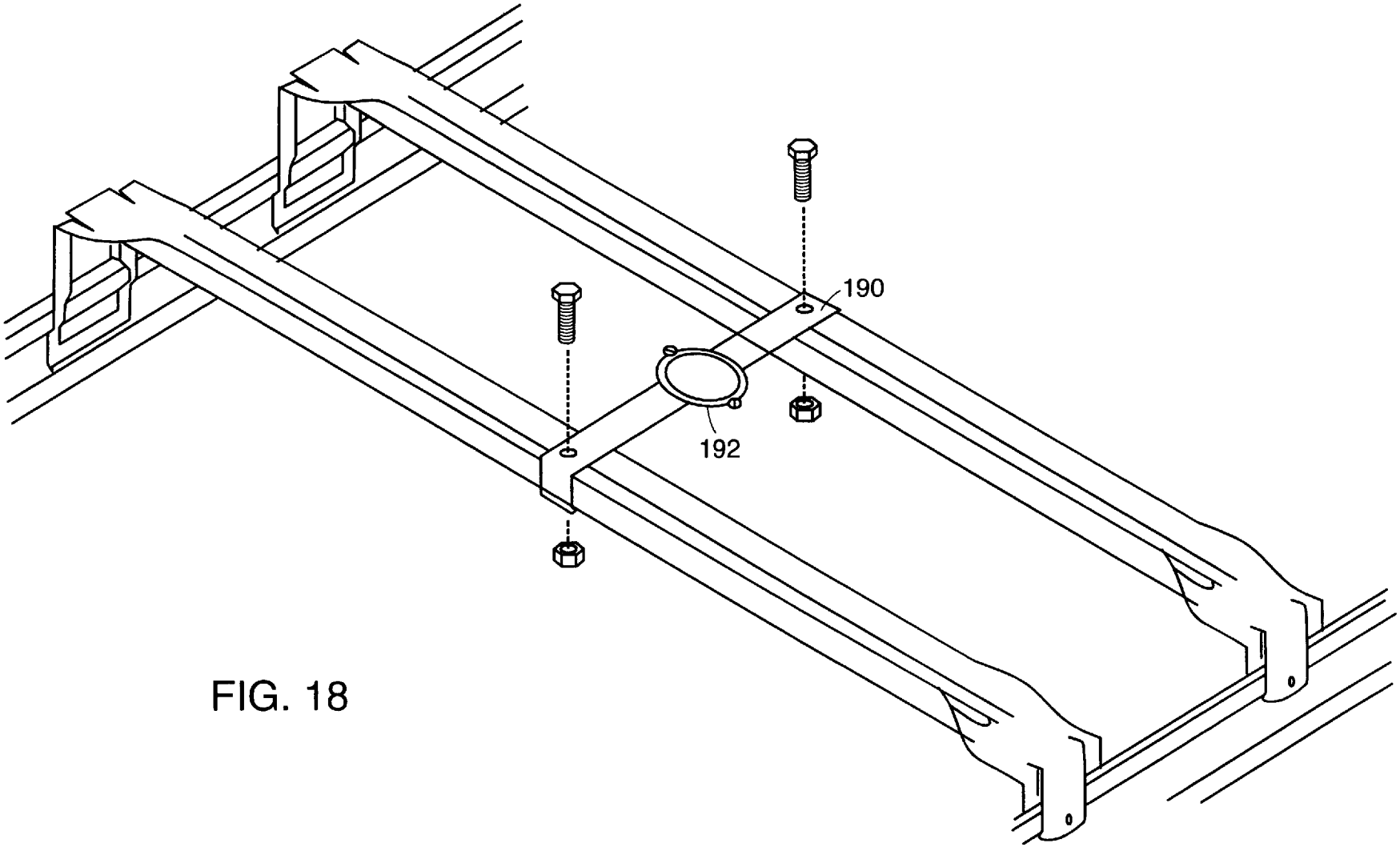
FIG. 18 is a perspective view, partially exploded, of an alternative embodiment of the central hub.

In alternative embodiments, as shown in FIG. 18, plate 44 can simply be a narrow strip 190 between legs 36, 38, with a ring 192 for a sleeve. Alternatively, plate 44 may support more than one sleeve 46, allowing multiple sprinkler heads 32, or simply offering the installer the choice of which sleeve to place the sprinkler head 32 into.

Figure 19:
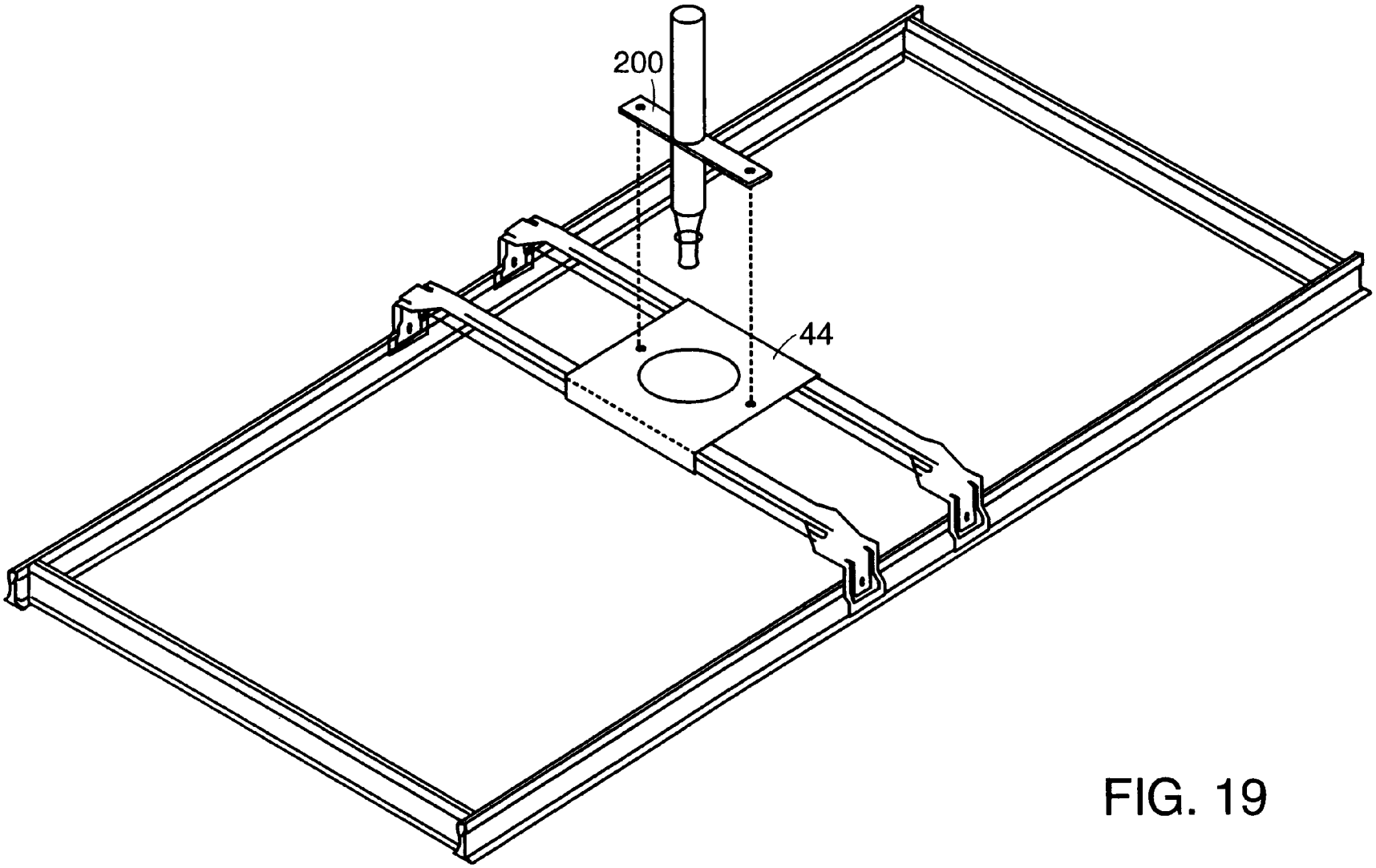
FIG. 19 is a perspective view, partially exploded, of an alternative embodiment of the central hub.

As shown in FIG. 19, sleeve 46 is formed as strip 200 with a hole in its center for the flexible sprinkler assemblage. Strip 200 can be two wings that are attached, e.g., welded, to the flexible sprinkler assemblage.

Plate 162 can be formed to include a flat section 180 and two bent sections 182, 184. The bent sections 182, 184 can be bent at approximately a 90° angle to the flat section, and are thus designed to slide over and attach to legs 36, 38.

In other embodiments the flexible hose used for conduit 20 can be constructed out of any material that is flexible in nature, including, but not limited to, stainless steel, stainless steel with a braided sleeve, other steels, rubbers, plastics, polymers, ferrous metals, non ferrous metals, polycarbonates, or any combination thereof.

In addition to flexible hose, conduit 20 can be any type of tubing, including plumbing pipe or PVC pipe.

Further, rivets, screws, nails, or other fastening devices can also be used to fasten plate 44 to legs 36, 38. In alternative embodiments plate 44 can also be formed with an integral clip to attach to legs 36, 38, or simply be designed to fold around or to snap on to legs 36, 38. Either of these embodiments can provide a break away mechanism in the event of support structure failure.

The order of steps the contractor follows during installation can be varied. By way of example, the contractor can first attach one or more of clips 50 on the ends of legs 36, 38 to ceiling frame section 8 at the approximate location desired. Support assembly 30 can be moved along frame section 8 to adjust the support assembly's 30 position. The position of central hub 40 on legs 36, 38 can also be adjusted to fine tune the position of sprinkler head 32 in the plane of the ceiling, wall or floor it is being installed in. Adjustments on these two axis allow the contractor to place sprinkler head 32 in the best position for safety or aesthetic reasons. If rod 110 is to be used it can be installed next.

Once the support system is in its proper location clips 50 are all attached to frame section 8, and central hub 40 is locked into place on legs 36, 38. At this point, if it has not already been installed, sprinkler head 32 can be positioned within sleeve 46, adjusting the sprinkler head's 32 position on the axis transverse to the plane of the ceiling, wall, or floor. Pipe 12, conduit 20, fitting 66, and sprinkler head 32 must all be connected and checked for leaks. By following this or a similar installation pattern support system 30 provides the contractor with maximum flexibility, allowing sprinkler head's 32 position to be adjusted in three dimensions.

Still other embodiments are within the following claims.

What is claimed is:

1. A support system for attaching a sprinkler head to a support structure in a ceiling, floor, or wall, the support system comprising:

a central hub adapted to receive a sprinkler head; and a first leg attached to the central hub and having first and second ends, each with fastening devices adapted to attach the ends of the first leg to the support structure, the fastening devices being configured to break away from the support structure in the event of support structure failure.

2. The support system of claim 1 further comprising an auxiliary support mechanism attached to the support system.

3. The support system of claim 2 wherein the auxiliary support mechanism is selected from the group consisting of a rod, a rope, a wire, and a chain.

4. The support system of claim 2 further comprising a second leg attached to the central hub, the second leg being substantially parallel to the first leg.

5. The support system of claim 4 wherein the support structure comprises a plurality of support members forming a rectangular frame, and the first end of the first leg and the second end of the second leg are each adapted to be attached to a first one of the plurality of support members of the support structure.

6. The support system of claim 4 wherein the first leg further comprises a third end, the second leg further comprises a fourth end, and the support structure comprises a plurality of support members to form a rectangular frame;

the first and third ends of the first leg are adapted to attach to a first one of the plurality of support members; and the second and fourth ends of the second leg are adapted to attach to a second one of the plurality of support members, the second one of the plurality of support members being parallel to the first one of the plurality of support members.

7. The support system of claim 4 further comprising third and fourth legs attached to the central hub.

8. The support system of claim 7 wherein the third and fourth legs are substantially perpendicular to the first leg.

9. The support system of claim 4 further comprising a flexible sprinkler assemblage, the flexible sprinkler assemblage comprising:

a flexible conduit;

a fitting attached to the flexible conduit; and the sprinkler head attached to the fitting.

10. The support system of claim 4 wherein the central hub comprises a plate and a sleeve, the sleeve being adapted to receive the sprinkler head.

11. The support system of claim 1 wherein the fastening devices are break away clips.

12. The support system of claim 11 wherein the break away clips comprise a loose rivet and a punched and bent metal sheet.

13. A support system for attaching a sprinkler head to a support structure in a ceiling, floor, or wall, the support system comprising:

a central hub adapted to receive a sprinkler head; and a first leg attached to the central hub and having first and second ends, each having fastening devices adapted to attach to the support structure, the fastening devices being configured to break away from the first leg in the event of support structure failure.

14. The support system of claim 13 further comprising an auxiliary support mechanism attached to the support system.

15. The support system of claim 14 wherein the auxiliary support mechanism is selected from the group consisting of a rod, a rope, a wire, and a chain.

16. The support system of claim 14 further comprising a second leg attached to the central hub, the second leg being substantially parallel to the first leg.

17. The support system of claim 16 wherein the support structure comprises a plurality of support members forming a rectangular frame, and the first end of the first leg and the second end of the second leg are each adapted to be attached to a first one of the plurality of support members of the support structure.

18. The support system of claim 16 wherein the first leg further comprises a third end, the second leg further comprises a fourth end, and the support structure comprises a plurality of support members to form a rectangular frame;

the first and third ends of the first leg are adapted to attach to a first one of the plurality of support members; and the second and fourth ends of the second leg are adapted to attach to a second one of the plurality of support members, the second one of the plurality of support members being parallel to the first one of the plurality of support members.

19. The support system of claim 16 further comprising third and fourth legs attached to the central hub.

20. The support system of claim 19 wherein the third and fourth legs are substantially perpendicular to the first leg.

21. The support system of claim 16 further comprising a flexible sprinkler assemblage, the flexible sprinkler assemblage comprising:

a flexible conduit;

a fitting attached to the flexible conduit; and the sprinkler head attached to the fitting.

22. The support system of claim 16 wherein the central hub comprises a plate and a sleeve, the sleeve being adapted to receive the sprinkler head.

23. A support system for attaching a sprinkler head to a support structure in a ceiling, floor, or wall, the support system comprising:

a central hub adapted to receive a sprinkler head;

a first leg attached to the central hub and having first and second ends adapted to attach to the support structure;

the central hub being configured to break away from the first leg and remain in place in the event of support structure failure.

24. The support system of claim 23 further comprising an auxiliary support mechanism attached to the support system.

25. The support system of claim 24 wherein the auxiliary support mechanism is selected from the group consisting of a rod, a rope, a wire, and a chain.

26. The support system of claim 24 further comprising a second leg attached to the central hub, the second leg being substantially parallel to the first leg.

27. The support system of claim 24 further comprising a flexible sprinkler assemblage, the flexible sprinkler assemblage comprising:

a flexible conduit;

a fitting attached to the flexible conduit; and the sprinkler head attached to the fitting.

28. A support system for attaching a sprinkler head to a support structure in a ceiling, floor, or wall, the support system comprising:

a central hub comprising a plate and a sleeve, the sleeve being adapted to receive a sprinkler head;

a first leg attached to the plate and having first and second ends adapted to attach to the support structure;

the sleeve being configured to break away from the plate and remain in place in the event of support structure failure.

29. The support system of claim 28 further comprising an auxiliary support mechanism attached to the support system.

30. The support system of claim 29 wherein the auxiliary support mechanism is selected from the group consisting of a rod, a rope, a wire, and a chain.

31. The support system of claim 29 further comprising a second leg attached to the central hub, the second leg being substantially parallel to the first leg.

32. The support system of claim 29 further comprising a flexible sprinkler assemblage, the flexible sprinkler assemblage comprising:

a flexible conduit;

a fitting attached to the flexible conduit; and the sprinkler head attached to the fitting.

33. A support system for attaching a sprinkler head to a support structure in a ceiling, floor, or wall, the support system comprising:

a central hub adapted to receive a sprinkler head; and a first leg attached to the central hub and having first and second ends, each with fastening devices adapted to attach the ends of the first leg to the support structure, the fastening devices being configured to break away from the support structure in the event of support structure failure; and an auxiliary support member attached to the support system.

* * * * *